United States Patent [19]

Browne

[11] Patent Number: 4,688,782

[45] Date of Patent: Aug. 25, 1987

[54] VERTICAL VACUUM CORRUGATION FEEDER

[75] Inventor: John M. Browne, Ontario, N.Y.

[73] Assignee: Xerox Corporation, Stamford, Conn.

[21] Appl. No.: 681,048

[22] Filed: Dec. 13, 1984

[51] Int. Cl.[4] ..... B65H 3/44

[52] U.S. Cl. ..... 271/9; 271/94; 271/34; 271/31.1; 271/149

[58] Field of Search ..... 271/9, 94, 95, 96, 34, 271/35, 33, 8.1, 11, 12, 116, 117, 118, 126, 127, 145, 148, 160, 5, 6, 14, 31.1, 149; 221/211; 414/330; 400/627, 176, 182, 183

[56] References Cited

U.S. PATENT DOCUMENTS

| | | | |
|---|---|---|---|
| 2,352,088 | 6/1944 | Evans | 271/9 |
| 3,086,771 | 4/1963 | Goin et al. | 271/31 |
| 3,527,458 | 9/1970 | Bond | 271/30 |
| 3,672,664 | 6/1972 | Santirocco et al. | 271/902 X |
| 3,720,409 | 4/1973 | Kubo et al. | 271/29 |
| 3,756,586 | 9/1973 | Craft | 271/9 |
| 3,826,485 | 7/1974 | Shindo | 271/106 |
| 3,851,871 | 12/1974 | Aronson | 271/11 |
| 3,861,667 | 1/1975 | Jahme | 271/11 |
| 3,961,784 | 6/1976 | Sevak et al. | 271/94 |
| 4,018,434 | 4/1977 | Mitchell et al. | 271/96 |
| 4,053,152 | 10/1977 | Matsumoto | 271/9 |
| 4,132,398 | 1/1979 | Erdmann et al. | 271/9 |
| 4,184,670 | 1/1980 | Rosendahl | 271/12 |
| 4,269,406 | 5/1981 | Hamlin | 271/108 |
| 4,324,395 | 4/1982 | Silverberg | 271/98 |
| 4,411,417 | 10/1983 | Browne | 271/94 |

*Primary Examiner*—Richard A. Schacher
*Attorney, Agent, or Firm*—William A. Henry, II

[57] ABSTRACT

A vertical vacuum corrugation feeder for separating and feeding sheets from either of two stacks includes a single feed mechanism positioned between the stacks having integral dual feed heads surrounded by at least one feed belt. The dual feed heads include vacuum plenums for pulling the sheets against the feed belt for forwarding away from the stacks.

20 Claims, 3 Drawing Figures

VERTICAL VACUUM CORRUGATION FEEDER

BACKGROUND OF THE INVENTION

This invention relates to a sheet feeding apparatus for feeding sheets one at a time from a sheet stack. More particularly, to a vacuum corrugation feeder that is not dependent on stack height and has unlimited stack capacity.

A need has been shown for the flexibility of medium to small copiers to be able to feed at least 500 sheets of 20 lb. paper with vacuum corrugation feeders such as described in U.S. Pat. Nos. 4,269,406 and 4,411,417 which are incorporated herein by reference. With these paper feeding devices, a stack of paper is substantially horizontally supported which makes it difficult for air to enter between the respective sheets in the stack. Since the bottom sheet in the stack is the first sheet to be fed and is in intimate contact with the next adjacent sheet there is a potential for double feeding. the main problem is how to relieve the force on sheet one of a stack (feeding from the bottom) by the most efficient and reliable method taking into consideration machine energy restrictions.

SUMMARY OF THE INVENTION

In accordance with the present invention, a vertical vacuum corrugation feeder apparatus is disclosed that operates to feed single sheets of any kind from a stack under constant load independent of stack height, generates maximum restraining force on sheets two and above thus descreasing multifeeds, permits a dual shared feed head and reduces machine power requirements.

In one aspect of the present invention, the feeder apparatus includes a pair of sheet support trays and a vacuum corrugation feeder mechanism positioned between the trays and adapted to alternately feed sheets vertically from the trays. The vacuum corrugation feeder mechanism has two acquisition chambers surrounded by a plurality of belts that drive sheets from either tray depending on whether the belts are driven clockwise or counterclockwise.

In another aspect of the present invention, a triple feed head is disclosed which comoprises a rectangular feed mechanism that is surrounded by feed belts. The feed mechanism has vacuum means therein that are used to separate and feed sheets from either of four trays.

BRIEF DESCRIPTION OF THE DRAWINGS

The foregoing and other features of the instant invention will be more apparent from a further reading of the specification and claims and from the drawings in which:

While the present invention will be described hereinafter in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 1:
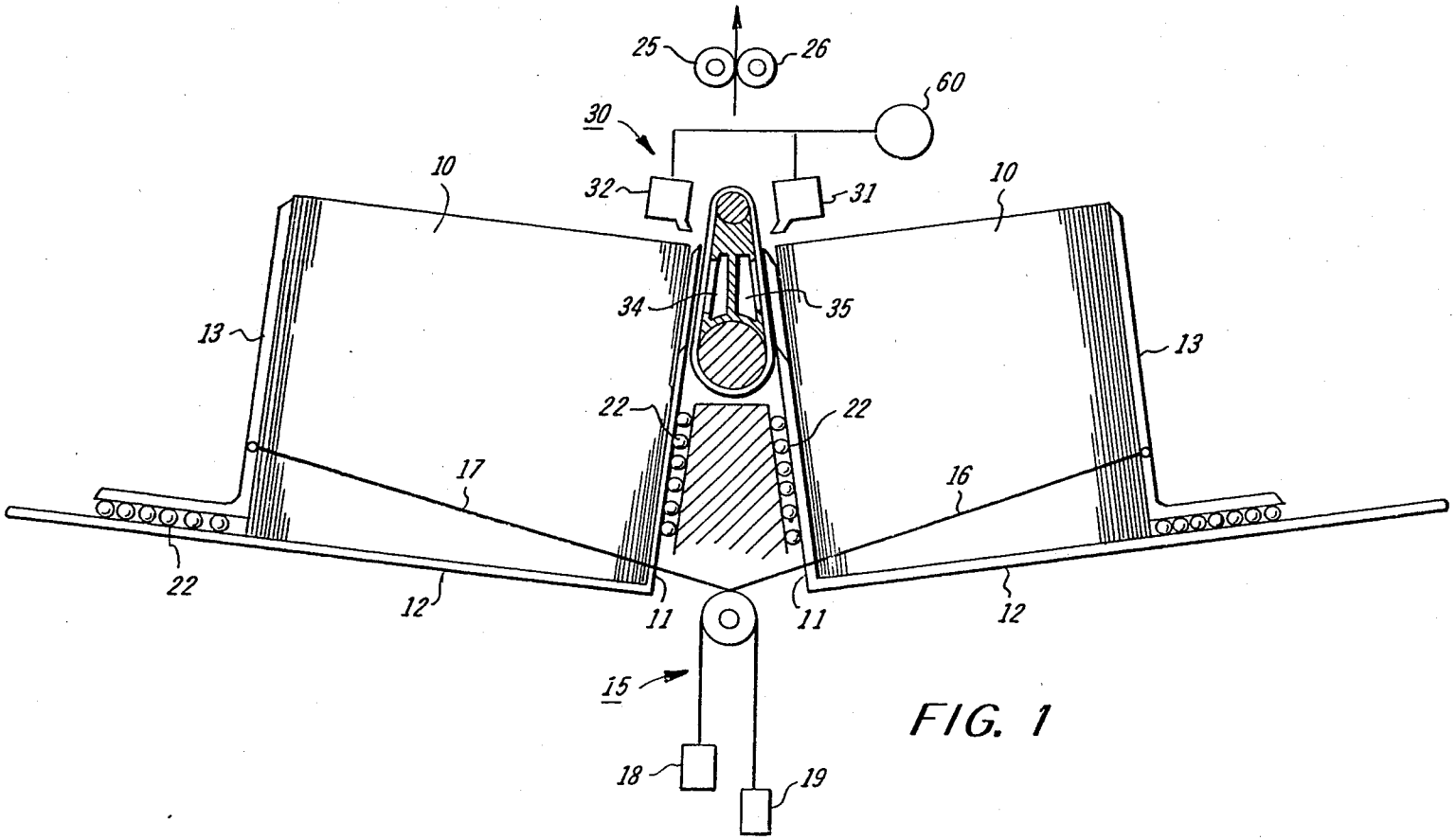
FIG. 1 is a schematic elevational view of a dual head vertical vacuum corrugation feeder in accordance with the instant invention.

Referring now to FIG. 1, a stack of sheets of paper 10 is vertically supported between a longitudinal side wall 11 of a paper feed base 12 and end plate 13. the stack of paper 10 is urged and restrained by the biasing of longitudinal plate 13 through a counter weight pulley system 15 and line 16 so that the stack is pressed toward longitudinal side wall 11.

Figure 2:
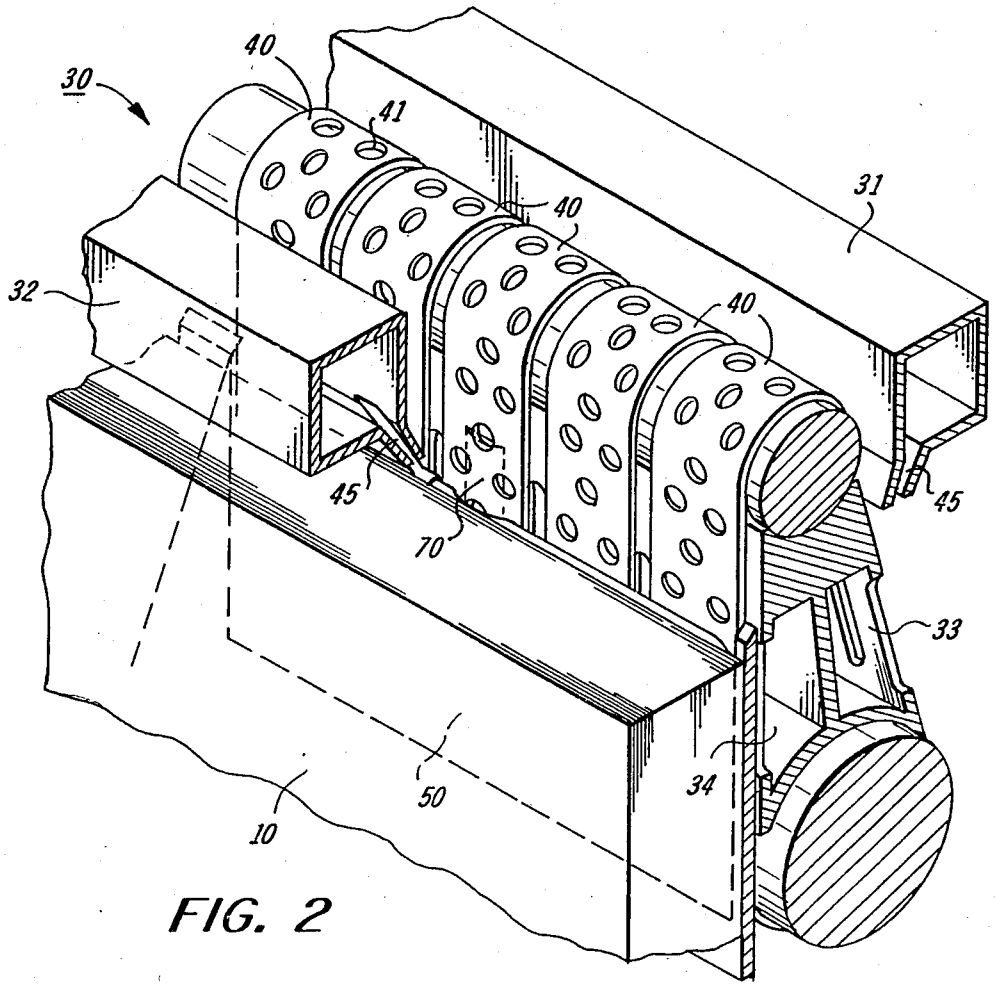
FIG. 2 is a partial isometric view of one of the feed heads shown in FIG. 1 and shows the corrugation means, separation pocket and air knives used to insure individual sheet separation.

In the embodiment shown in FIG. 1, a pair of left and right paper feed bases or trays 12, each receiving therein a stack of paper 10 of respectively different sizes are arranged opposite each othr. A sheet separator and feeder 30 is positioned between the stacks and adapted to alternately feed from either tray depending on which tray is selected for feeding. The sheet separator and feeder 30 includes integral dual feed heads having sheet acquisition plenums 33 and 34. Flexible belts 40 surround the integral feed heads and are used to frictionally drive sheets from either tray once actuated for feeding by a conventional machine controller or microprocessor. the belts 40 have holes 41 therein that allow vacuum chambers 33 and 34 to drawn sheets against the belts for forwarding toward take-away rolls 25 and 26. Air knife jets or nozzles 45 in FIG. 2 are positioned above the belts and mounted such that they issue sheet separation streams from plenums 31 and 32 directed precisely at the leading edges of the acquired sheets. Virgin stacks of paper when placed vertically will "grown" in thickness as air filters down through and between the sheets into spaces that appear to arise due to slight ripples in the sheets. This percollation of air between the sheets which does not happen when sheets are horizontally stacked on top of each other will aid acquisition, separatin and removal of sheets from the stacks. An integral dual feed head positioned between two vertical stacks as disclosed has considerable utility, such as, insertion of special sheet sizes, weights, colors or limitless feeding in the sense that as one tray is emptied of sheets, feeding is automatically switched to the opposite tray. Also, with the ability to feed sheets alternately from two trays and advantage of inherent symmetry (with respect to gravity), this feed head could be used with a dual photoreceptor duplex processor having vertical paper transport.

A corrugation pocket 50 is shown in FIG. 2 in the tray on the left and has a main function of enhancing the separation of the sheet closest to side 11 from the rest of the stack. It allows vacuum plenums 33 and 34 to be closer to the sheets and therefore acquisition can be effected with a small vacuum. A raised ridge 70 is built into the vacuum plenums with one of the belts riding thereover. This ridge or corrugation means causes a sheet captured by the vacuum plenums to assume a double valley configuration thereby creating an envelope type opening or pocket between the bottom sheet and the remainder of the sheets in the stack for the injection of air from the air knives 31 and 32. A conventional single vacuum source 35 is connected to the vacuum plenums. The vacuum source is suitably valved such that when sheets are fed from one tray the vacuum plenum associated with the other tray is cut off and vice versa. However, the system will work if both sets of plenums are ON at the same time since the rotation of the belts either clockwise or counterclockwise would cause sheets from one tray to feed out while simultaneously inhibiting movement of sheets in the other tray.

Stack normal force is achieved in the present embodiment by tray end movement that is assisted by counter weights 18 and 19 over pulley 20. The force may be simply adjusted, if necessary, to optimize for different types of sheet feed conditions, e.g., paste-ups, card stock, etc. This can be done, for example, by selecting a combinatio out of 3 counter-weights (weights 1, 2 and 4 gives combination 0, 1, 2, 3, 4, 5, 6, 7). Also, highly curled sheets or sheets with a tendency to curl or sag could be stored in the stacks under a higher-than-weight force. When the machine is turned ON, this force would be relieved. This permits some of the curl to be removed from the sheets before feeding. If desired, a small normal force may be obtained by applying a small angle to the tray with respect to the horizontal. The trays may be removed from their feeding position for reloading by pulling them toward the user on rollers 22 and then tipping them (almost) vertically at the same time releasing the end plates. I this way, the stacks will never have the opportunity to collapse. Both trays are adapted to be rolled back leaving vertical spaces for duplex or other functioning. In this way it is possible to arrange a tray-within-a-tray-within-a-tray also. The trays move up and down for different sizes of paper and are configured the same as the sheet support tray in U.S. Pat. No. 4,411,417.

By suitable valving and controls it is desirable to provide a delay between the time the vacuum is applied to pull sheet one onto the belts and the start up of the feed belts to assure that sheet one is captured on the belts before belt movement commences and to allow for the air plenum to separate sheet one from any sheets that were pulled to the belts with it.

In operation, a stack of sheets is placed in one of the trays and that particular tray (e.g., the tray on right of FIG. 1) is selected by the user or automatically selected by the machine software and the following sequence of events occurs. Positive pressure source 60 is actuated supplying positive pressure to plenum 31 and vacuum source 35 is actuated at the same time supplying negative pressure to vacuum plenum 33. Air pressure from nozzles 45 apply in the air knife a steady stream of pressure to the front edge of the stack tending to separate the sheet closest to nozzles (sheet one) from the remainder of the sheets. At the same time, vacuum plenum 33 pulls sheet one down onto the drive belts 40 causing a corrugation to appear in the sheet thereby further enhancing the separation effects of nozzles 45. The feed belt assembly is actuated, driving sheet one away from the stack in a forward direction. As the leading edge of sheet one enters the take-away rolls, the vacuum plenum is turned OFF and for each successive sheet being fed the cycle is repeated.

Figure 3:
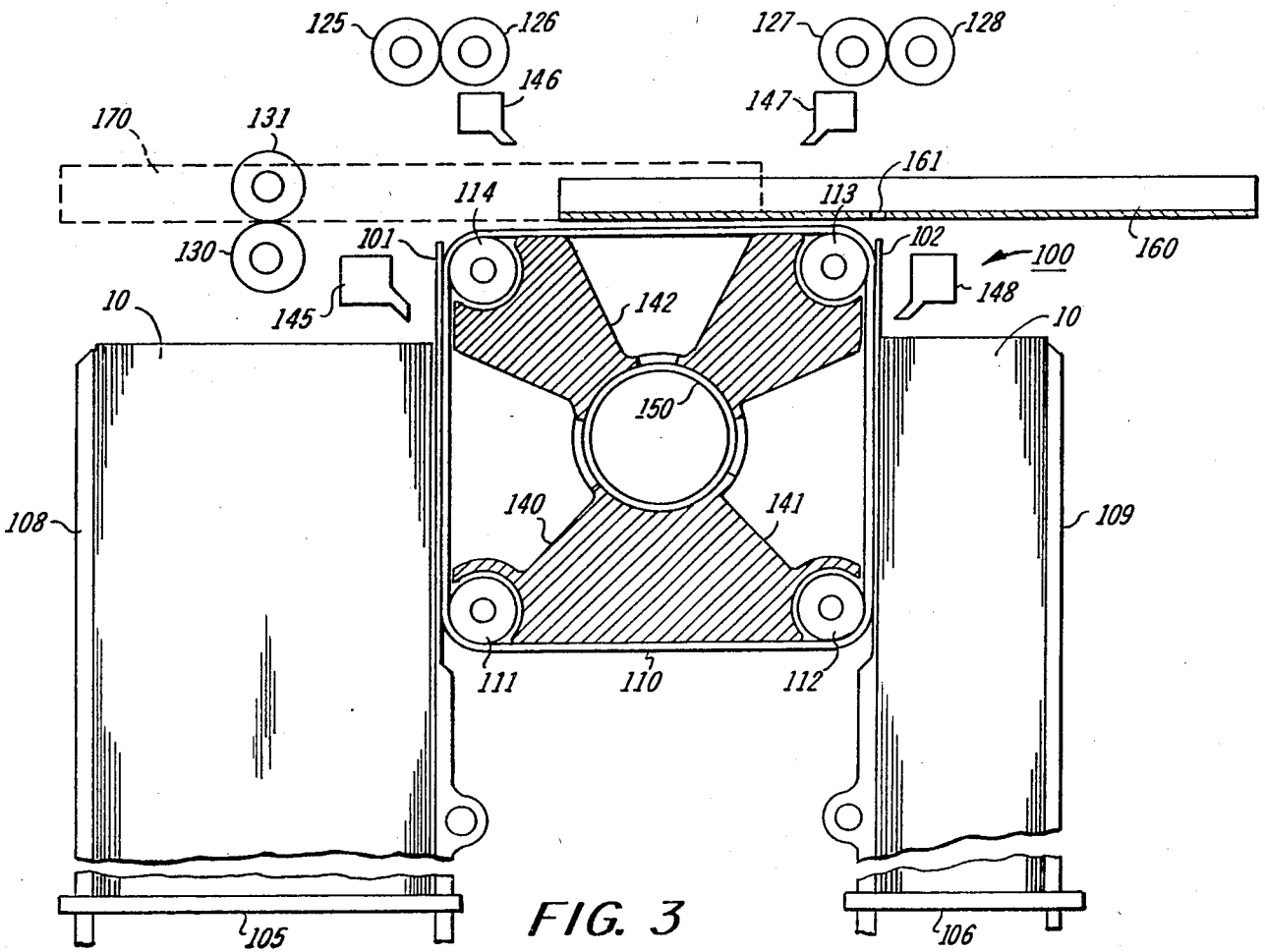
FIG. 3 is a schematic elevational view of an alternative embodiment of the instant invention that includes a triple feed head mechanism.

An alternative embodiment of the present invention is shown in FIG. 3 and comprises a combination main, auxiliary and duplex triple feeding head 100 capable of feeding from a vertical main or auxiliary tray and two horizontal duplex trays. Feed head 100 is square as shown (it could be rectangular if desired) and drives sheets from the main tray 105 by the use of belts 110 rotatably driven by rolls 111–114 in a clockwise direction and into take-away rolls 125 and 126. A rotary valve 150 in the center of the feed head valves negative pressure to vacuum plenums 140 and 141 which are contained within feed head 100. When the feeding of a sheet from, for example, main tray 105 is required, air pressure from air knife plenum 145 exits through a jet and is directed against the front edge of sheets 10 in the stack and tends to separate the first sheet from the next adjacent sheet while a negative pressure from plenum 140 through holes in the belts 110 pulls the sheet to the surface of belts 110. The acquired sheet is forwarded to take-away rolls 125, 126 for further advancement. Sheet one is fed from tray 106 to take-away rolls 127, 128 similarly, only belts 110 are rotated counterclockwise upon a signal from the machine controller.

A horizontal duplex tray 160 is situated on the horizontal top side of the feed head. Sheets in duplex tray 160 are separated from the bottommost sheet by air from air knife plenum 146 and are acquired by belts 110 through negative pressure from vacuum plenum 142. Rotating the belts counterclockwise drives the sheets from the tray to take-away rolls 130, 131. A second duplex tray 170 is shown to the left in the dotted lines. This arrangement permits duplexes from paper in either the main or auxiliary tray provided the take-away rolls are removed. Tray 170 would be serviced by air plenum 147 and vacuum plenum 142. Trays 105, 106 160 and 170 preferably have pockets therein in order for a corrugation means on the feed heads to corrugate the sheets and enhance single sheet feeding. Duplex tray 160 does not have to be removed for feeding from the auxiliary tray since the auxiliary feeder can feed straight through a slot 161 in the base of the tray. Also, it should be understood that trays 105 and 106 are adjustable vertically to accommodate different sizes of sheets.

It will be appreciated from the above description of the embodiments of the present invention that a much more efficient feeding system has been disclosed. For example, since there is a light load on sheet one (vertical feeding), there will be very little frictional force tending to drag against it deforming into the pocket during acquisition. This will in turn minimize the vacuum requirements and consequently decrease failures due to the permeability of sheet one causing sheet two also to acquire as is sometimes the problem with bottom vacuum corrugation feeders (BVCF). The decreased frictional drag will also tend to obviate the problem of dragging it into the pocket and then requiring the air knife to buckle it away again. Also, with this system the stack height is effectively limited only by the amount of available space in the machine. The blow away problems of BVCF's for small stacks of lightweight sheets is also obviated since the sheets cannot blow out of the stack. A further advantage of the present system is tha during the removal process, sheet two is restrained in the stack by its weight force together with the friction with sheet three which is also constrained by its weight force, etc. Also, stacks of any size can be fed because the stack no longer needs to be levitated.

It will be appreciated that the described devices may be modified and varied by the skilled artisan upon a reading of the present disclosure. Such modifications are intended to be within the scope of the present invention.

What is claimed is:

1. A vertical vacuum corrugation feeder for separating and feeding sheets individually from a stack or stacks without being limited by stack heights, comprising:

a pair of stack trays adapted for supporting separate virgin stacks of sheets on their ends substantially vertically and under constant load independent of stack height, and dual feed head vacuum sheet feed means associated with said pair of trays and located in a position spaced from the closest adjacent sheet in each stack for feeding sheets upwardly from either stack in a substantially vertical direction with respect to a horizontal plane, said dual feed head vacuum sheet feed means being an integral unit and having at least one belt surrounding the integral unit and both feed heads and separate vacuum plenum means, and air injection means for each head, wherein each of said air injection means is adapted to provide a layer of air between the sheet closest to said air injection means and the remainder of the sheets in the stack, and each of said vacuum plenum means is adapted to attract the sheet adjacent thereto to said at least one belt for forwarding out of said tray.

2. The feeder of claim 1, wherein sheets are fed alternatively from either tray without adjusting the feed heads or trays.

3. The feeder of claim 2, wherein said at least one belt is adapted for clockwise or counterclockwise rotation depending on which tray is selected for sheet feeding.

4. The feeder of claim 1, wherein said dual feed head vacuum sheet feed means includes means for corrugating each sheet attracted thereto by said vacuum plenum means in order to enhance the separation of the first sheet to be fed from the next adjacent sheet and wherein said dual feed head vacuum sheet feed means is positioned at an angle in relation to said pair of trays and with respect to a horizontal plane for normal force purposes.

5. The feeder of claim 1, wherein single sheets are individually fed alternately from either tray.

6. A vacuum feeder apparatus for separating and feeding sheets individually from a stack or stacks without being limited by stack heights, comprising:

multiple trays adapted for supporting separate stacks of virgin sheets, and vacuum feed head means fixedly positioned adjacent the closest sheet thereto in each of said multiple trays and adapted to separate and feed sheets upwardly individually in a vertical direction with respect to a horizontal plane from any selected one of said multiple trays on demand, said vacuum feed head means having at least one belt surrounding its outer surface and a means to apply a vacuum through openings in said at leat one belt to the sheets in said multiple trays, and air injection means for each of said multiple trays, wherein said air injection means is adapted to provide a layer of air between the sheet closest to said vacuum feed head means and the remainder of the sheets in the stack, such that the sheet closest to said vacuum feed head means of the tray selected for feeding will be attracted to said at least one belt for forwarding out of the tray.

7. The vacuum feeder apparatus of claim 6, wherein said at least one belt is adapted for clockwise or counterclockwise rotation in order to feed sheets from different ones of said multiple trays.

8. The vacuum feeder apparatus of claim 7, wherein feeding sheets from one of said multiple trays includes feeding the sheets through an opening in the bottom of another of said multiple trays when said another of said multiple trays is empty.

9. The vacuum feeder apparatus of claim 6, wherein said multiple trays include a main tray, an auxiliary tray and at least one duplex tray.

10. The vacuum feeder apparatus of claim 6, wherein said multiple trays include two duplex trays with one of said duplex trays being moveable to a non-feeding position to allow feeding from another of said multiple trays.

11. The vacuum feeder apparatus of claim 10, wherein said multiple trays include a main tray and an auxiliary tray, said main and auxiliary trays being adapted for vertical feeding and said duplex trays being adapted for horizontal feeding.

12. The vacuum feeder apparatus of claim 6, wherein said vacuum feed head means is rectangular in shape.

13. The vacuum feeder apparatus of claim 6, including means for corrugating sheets as they are fed.

14. The vacuum feeder apparatus of claim 11, wherein a series of five belts surround the outer surface of said vacuum feed head means and vacuum supply means applies vacuum through the openings in said series of belts such that said sheet closest to said vacuum feed head means will be attracted to said series of belts.

15. The vacuum feeder apparatus of claim 6, wherein said vacuum feed head means includes multiple feeding surfaces.

16. The vacuum feeder apparatus of claim 15, wherein said multiple feeding surfaces of said vacuum feed head means includes two vertical feeding surfaces and one horizontal feeding surface.

17. A paper feeder, including a vacuum corrugation feeder vertically positioned such that said feeder is not limited by the height of sheets in stacks, and two paper trays for storing paper sheets positioned vertically on both sides of said vacuum corrugation feeder for sheet feeding from either tray upwardly against the pull of gravity.

18. The paper feeder of claim 17, wherein said vacuum corrugation feeder comprises dual feed heads with belt means surrounding said feed heads and adapted to forward sheets from either tray depending on whether said belt means is rotated clockwise or counterclockwise.

19. A vertical sheet separator feeder for separating and fowarding sheets seriatim without being limited by stack heights, comprising:

a pair of stack trays adapted for vertically supporting stacks of sheets on their ends, frictional feed means comprising a plurality of feed belts spaced from the supported position of the planar surface of the sheet closest thereto in each stack, means forming dual vacuum plenums associated with said feed means, said vacuum plenums having openings therein facing the sheet closest thereto in each stack, and having a raised portion therein underlying at least one of said belts to raise at least one of said belts above the plane of the top surface of the remainder of said belts, means for lowering the air pressure in said plenums below atmospheric pressure causing the sheet closest thereto in the stacks to be drawn into contact with and acquired by said feed means, said feed belts thereby forming a corrugation in said sheet by said raised belt for separation and forwarding of the bottom sheet from said stack upwardly in a vertical direction with respect to a horizontal plane; and, separate air knife means for each tray adapted to direct an air flow against the lead edge of the acquired sheet in the stack and reduce drag forces between the acquired sheet and the remainder of the stack.

20. A vertical feeder for separating and feeding sheets individually from a stack or stacks without being limited by stack heights, comprising:

a pair of stack trays adapted for supporting separate stacks of sheets substatially vertically, and dual feed head vacuum sheet feed means associated with said pair of trays and located in a position spaced from the closest adjacent sheet in each stack for feeding sheets from either stack, said dual feed head vacuum sheet feed means being an integral unit and having at least one belt surrounding the integral unit and both feed heads and separate vacuum plenum means, and air injection means for each head, wherein each of said air injection means is adapted to provide a layer of air toward the stack of sheets to be fed and between the sheet closest to said dual feed head vacuum sheet feed means and the remainder of the sheets in the stack, and each of said vacuum plennum means is adapted to attract the sheet adjacent thereto to said at least one belt for forwarding out of said tray upwardly in a vertical direction with respect to a horizontal plane.

* * * * *